US010006622B2

(12) United States Patent
Quadri et al.

(10) Patent No.: US 10,006,622 B2
(45) Date of Patent: Jun. 26, 2018

(54) SCENOGRAPHIC LIGHT FIXTURE

(71) Applicant: CLAY PAKY S.p.A., Seriate (IT)

(72) Inventors: Aris Quadri, Seriate (IT); Roberto Midali, Torre (IT)

(73) Assignee: CLAY PAKY S.P.A., Seriate (IT)

( * ) Notice: Subject to any disclaimer, the term of this patent is extended or adjusted under 35 U.S.C. 154(b) by 233 days.

(21) Appl. No.: 14/966,467

(22) Filed: Dec. 11, 2015

(65) Prior Publication Data

US 2016/0305644 A1 Oct. 20, 2016

(30) Foreign Application Priority Data

Apr. 15, 2015 (IT) ..... MI2015A0539

(51) Int. Cl.

| | |
|---|---|
| ***F21V 17/00*** | (2006.01) |
| ***F21V 21/22*** | (2006.01) |
| ***F21V 31/00*** | (2006.01) |
| ***F21V 3/06*** | (2018.01) |
| ***F21S 10/06*** | (2006.01) |
| ***F21V 14/04*** | (2006.01) |
| ***F21V 15/01*** | (2006.01) |
| ***F21V 29/67*** | (2015.01) |
| ***F21V 3/04*** | (2018.01) |
| ***F21V 21/30*** | (2006.01) |
| *F21W 131/406* | (2006.01) |
| *F21W 131/10* | (2006.01) |

(52) U.S. Cl.

CPC ..... *F21V 31/00* (2013.01); *F21S 10/06* (2013.01); *F21V 3/0436* (2013.01); *F21V 3/062* (2018.02); *F21V 14/04* (2013.01); *F21V 15/012* (2013.01); *F21V 17/002* (2013.01); *F21V 21/22* (2013.01); *F21V 21/30* (2013.01); *F21V 29/67* (2015.01); *F21V 29/677* (2015.01); *F21W 2131/10* (2013.01); *F21W 2131/406* (2013.01)

(58) Field of Classification Search

CPC ... F21W 2111/00; F21V 31/00; F21V 29/677; F21V 21/22; F21V 29/67; F21V 15/012; F21S 10/06; F21S 10/063; F21S 10/066

See application file for complete search history.

(56) References Cited

U.S. PATENT DOCUMENTS 2,740,103 A 3/1956 Gosswiller
2,748,371 A * 5/1956 Wilcox ..... B64D 47/06 246/473.3

(Continued)

FOREIGN PATENT DOCUMENTS

DE 10 2005 054031 5/2007
EP 643257 3/1995

(Continued)

*Primary Examiner* — Alexander Garlen
*Assistant Examiner* — Eric T Eide
(74) *Attorney, Agent, or Firm* — Leason Ellis LLP

(57) ABSTRACT

A scenographic light fixture for producing a light beam has a main body configured to produce a light beam along an optical axis; a control device facing the main body and comprising a mobile optical element to intercept and selectively deflect the light beam in a plurality of directions; and a support, at least in part transparent to the light beam, fitted to the main body to support the control device and so as to define a waterproof chamber wherein the optical element moves.

15 Claims, 4 Drawing Sheets

(56) References Cited

U.S. PATENT DOCUMENTS 4,054,791 A * 10/1977 Du Shane ..... F21L 2/00 362/35
5,590,955 A * 1/1997 Bornhorst ..... F21S 10/06 362/232
5,607,217 A 3/1997 Hobbs, II
7,819,538 B2 * 10/2010 Nobayashi ..... B60Q 1/2611 362/277
2003/0137842 A1 * 7/2003 Chang ..... F21S 10/06 362/284
2004/0155590 A1 8/2004 Belliveau
2007/0263376 A1 11/2007 Wilkinson et al.
2009/0067156 A1 * 3/2009 Bonnett ..... G02B 6/0043 362/97.2
2011/0249443 A1 * 10/2011 Jurik ..... F21V 3/02 362/294
2011/0249457 A1 * 10/2011 Jurik ..... F21V 21/15 362/418
2012/0033419 A1 * 2/2012 Kim ..... F21S 8/026 362/235
2012/0320621 A1 * 12/2012 Kleo ..... B32B 17/10018 362/558
2013/0063947 A1 * 3/2013 Knappschneider ..... F21S 2/00 362/277
2013/0208481 A1 * 8/2013 Sooferian ..... F21V 14/02 362/280
2014/0313744 A1 * 10/2014 Collias ..... F21K 9/50 362/311.02
2015/0145994 A1 * 5/2015 Quadri ..... F21V 21/30 348/144
2016/0161082 A1 * 6/2016 Huang ..... F21S 48/234 362/514

FOREIGN PATENT DOCUMENTS

| | | |
|---|---|---|
| EP | 1211545 | 6/2002 |
| GB | 2 106 233 | 4/1983 |
| GB | 2 435 090 | 8/2007 |
| WO | WO 2011/119452 | 9/2011 |
| WO | WO 2013/190473 | 12/2013 |

* cited by examiner

SCENOGRAPHIC LIGHT FIXTURE

CROSS-REFERENCE TO RELATED PATENT APPLICATIONS

The present application claims the benefit of priority under 35 U.S.C. § 119 of Italian patent application serial No. MI2015A000539, filed Apr. 15, 2015, which is hereby incorporated by reference in its entirety.

BACKGROUND OF THE INVENTION

Scenographic light fixtures are used in the entertainment industry to create scenographic effects using light beams.

The entertainment industry is always looking for new scenographic effects, and for powerful, high-performing light fixtures that can also be used outdoors.

A scenographic light fixture generally comprises a light source for generating a light beam along an optical axis; an objective lens; at least one light beam processing device that is selectively interposed between the light source and the objective lens, and a cooling system. The source, the light beam processing device and the cooling device are enclosed within a main body, generally known as a "head", delimited by walls and by the objective lens. The cooling system consists of drawing in air through inlets arranged in the walls, making the air circulate inside the main body, especially in correspondence with the light source, and discharging the hot air through outlets arranged in the walls.

The light beam can generally be orientated by rotating the main body about two axes, known as the pan and tilt axes. Other methods for orientating the light beam consist of deflecting the light beam using an optical element, which is configured to intercept the light beam and which can be selectively orientated about two respective pan and tilt axes opposite the objective lens in order to selectively intercept the light beam and direct it in a plurality of directions. Some light fixtures that make use of mobile optical elements to deflect the light beam are described in documents EP 643,257, EP 1,211,545 and WO 2013/190473.

The scenographic light fixtures known in the prior art cannot be used outdoors regardless of the methods used to orientate the light beam because none of them meet the dust and water protection requirements of current safety regulations.

SUMMARY OF THE INVENTION

One purpose of the present invention is therefore to provide a scenographic light fixture capable of offering a wide range of performance characteristics and, at the same time, that can guarantee a high level of protection.

According to the present invention there is provided a scenographic light fixture for producing a light beam, the light fixture comprising a main body configured to produce a light beam along an optical axis; a control device facing the main body and comprising a mobile optical element to intercept and selectively deflect the light beam in a plurality of directions; and a support, which is at least in part transparent to the light beam, and is fitted to the main body to support the control device so as to define a waterproof chamber wherein the optical element moves.

In this way, the main body can produce a light beam with the desired characteristics, the control device is able to deflect the beam in at least one direction without having to turn the main body, and the optical element is supported by a transparent support inside a waterproof chamber. The light beam can be deflected in a plurality of directions by moving the mobile element. In this way, the optical element of the main body, and the control device can be adequately protected against external agents without undermining the efficiency of the light fixture. Furthermore, the control device and the respective electric motors for controlling the optical element are also protected against external agents.

According to a preferred embodiment of the present invention, the support is cup-shaped and the control device is housed in the chamber.

In particular, the support comprises an end flange, which is hermetically fitted to the main body to prevent water and dust from entering the chamber.

In particular, the support comprises a transparent lateral wall and a bottom wall along which the control device is fixed.

Clearly, the control device is fixed in place before fixing the support to the main body.

In particular, the support is made of polymeric material, specifically Polymethylmethacrylate (abbreviation: PMMA) or Polycarbonate (abbreviation: PC), which are lightweight materials, have good optical properties and are robust enough to support the control device.

In particular, the support is configured so as to comprise one optically active portion in order to modify the optical characteristics of the light beam.

In this way, the support can also contribute to the creation of scenographic effects.

In particular, the light fixture comprises a plurality of interchangeable supports. The fact that the support is interchangeable is particularly important when the supports have different characteristics in terms of their size or optical properties so as to be used according to the specific circumstances.

In particular, the support has an outer surface which is coated with a water-repellent coating to attenuate the formation of droplets of water on the outer surface of the support.

In particular, the support is UV opaque so that prolonged exposure to the sun does not result in an excessive increase in the temperature inside the chamber.

According to an alternative embodiment of the present invention, the main body comprises a ring that is rotatable about the optical axis, said support being mounted on said rotatable ring.

This makes it possible to achieve scenographic effects when the support comprises areas designed to alter the light beam.

In particular, the support is telescopic and can be extended and shortened along the optical axis.

It is thus possible to extend the range of action of the light beam.

In particular, the control device comprises a first motor configured to rotate the optical element about a first axis that coincides with the optical axis and a second motor configured to pivot the optical element about a second axis transversal to the first axis. It is thus possible to rotate the optical element about two axes that are orthogonal to each other, in the so-called tilt and pan directions, simply by turning the optical element rather than moving the entire light fixture.

In particular, the main body comprises an air cooling system comprising at least one inlet and at least one outlet arranged along an outer wall of the main body extending about the optical axis, said inlet and said outlet being arranged so that said outer wall comprises a hermetically sealed zone which subtends an angle B of at least 120° about the optical axis.

This means the light fixture can be arranged in a position in which bad weather conditions cannot penetrate inside the main body.

In particular, the air cooling system comprises a plurality of inlets, and at least two outlets arranged at 90° with respect to the inlets with reference to the optical axis.

In particular, the main body comprises a light source, an objective lens, and at least a light beam processing device configured to selectively intercept the light beam and create scenographic effects. The main body thus has the main function of producing the light beam and creating scenographic effects by processing said light beam.

BRIEF DESCRIPTION OF THE DRAWINGS

Further characteristics and advantages of the present invention will become clear from the following description of non-limiting embodiments thereof, with reference to the figures in the accompanying drawings, in which.

DETAILED DESCRIPTION OF THE INVENTION

Figure 1:
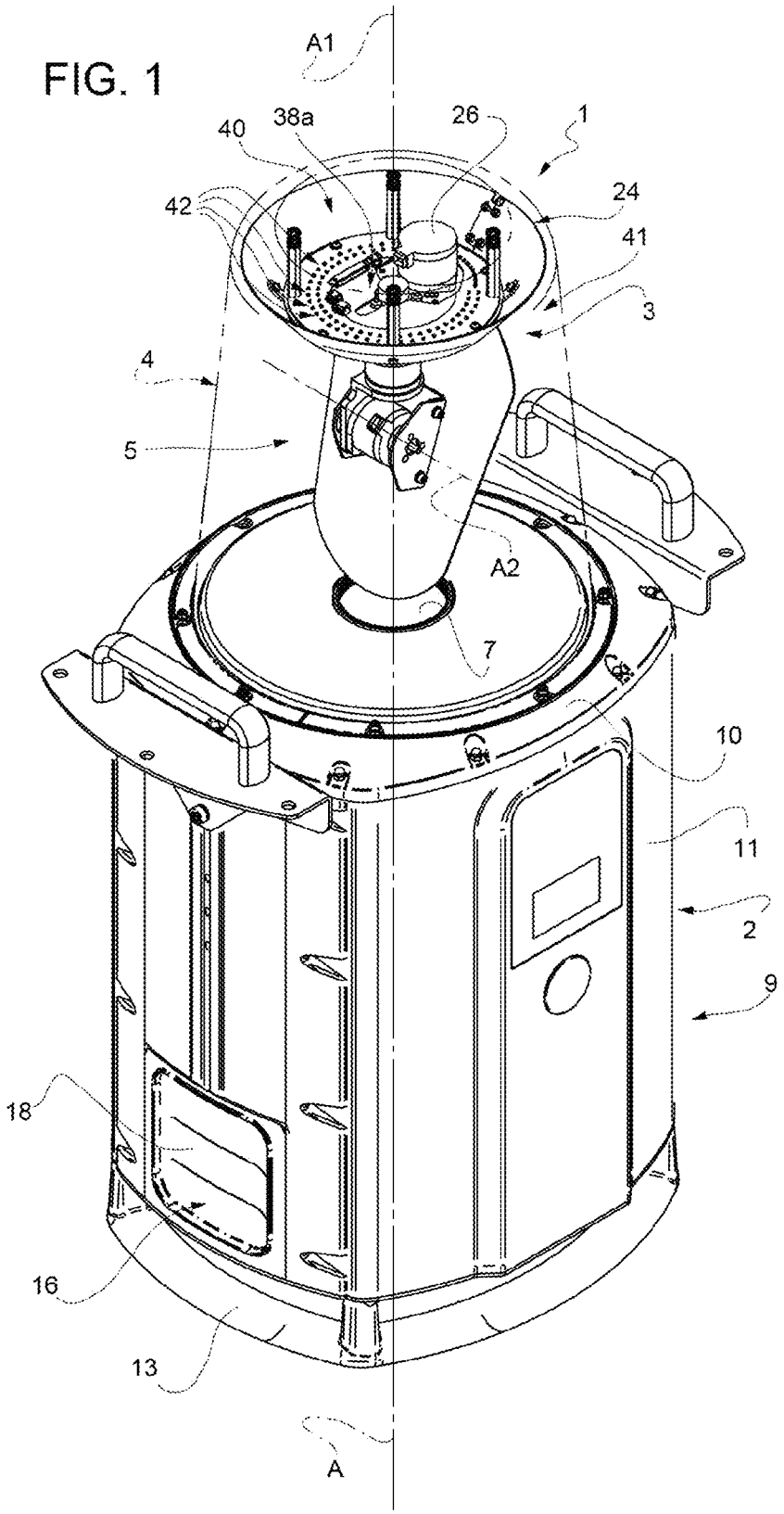
FIG. 1 is a perspective view, with parts removed for the sake of clarity, of an embodiment of the scenographic light fixture according to the present invention.

In FIG. 1 denoted by reference numeral 1 is a scenographic light fixture comprising a main body 2 configured to generate a light beam along an optical axis A; a control device 3 configured to intercept the light beam and direct the light beam in a plurality of directions; and a support 4, which is fitted to the main body 2 to support the control device 3 facing the main body 2 and define a waterproof chamber 5.

Figure 3:
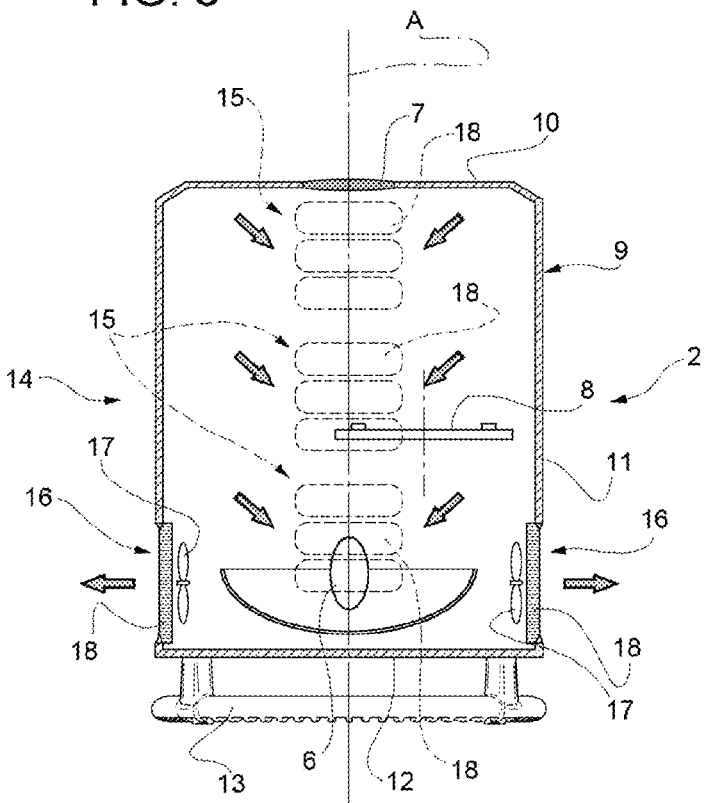
FIG. 3 is a schematic, reduced-scale elevation view, with parts removed for the sake of clarity, of a further detail of the scenographic light fixture of FIG. 1.

With reference to FIG. 3, the main body 2 comprises a light source 6 to generate the light beam; an objective lens 7 to collimate the light beam; and at least one light beam processing device 8 to produce optical effects. The main body 2 has a casing 9 delimited by an upper wall 10, a lateral wall 11, and a bottom wall 12 from which a pedestal 13 projects. The objective lens 7 extends along the upper wall 10, while the light source 6 and the light beam processing device 8 are housed within the casing 9.

The main body 2 is fitted with a cooling system 14 to discharge the heat produced by the light source 6.

Figure 4:
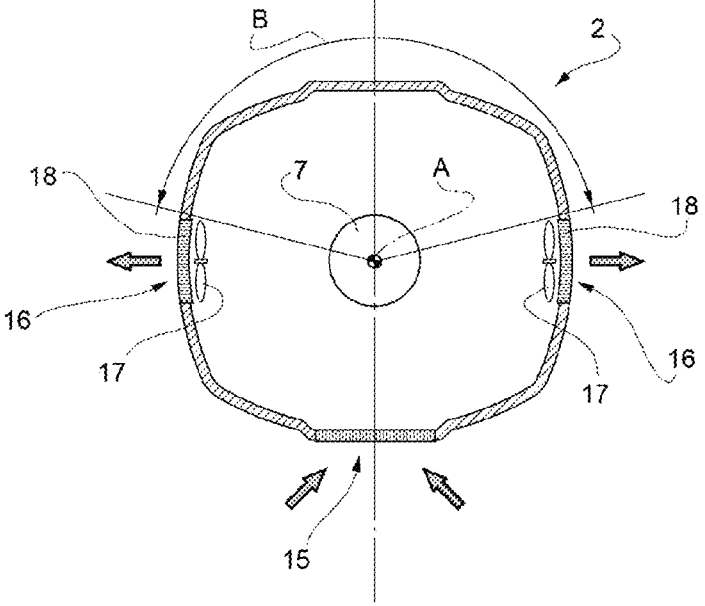
FIG. 4 is a schematic plan view of the detail of FIG. 3, with some parts removed for the sake of clarity.

As illustrated more clearly in FIGS. 3 and 4, the cooling system 14 comprises inlets 15 through which the air is delivered to the inside of the casing 9 and two outlets 16 through which the hot air is discharged. The inlets 15 and the outlets 16 are arranged around the optical axis A along a portion of the lateral surface subtended by an angle of less than 240° so that a portion of the lateral surface subtended by an angle B of 120° has no openings towards the outside.

The cooling system 14 further comprises fans 17 arranged at the outlets 16 and water-repellent filters 18 arranged at the inlets 15 and at the outlets 16.

Figure 2:
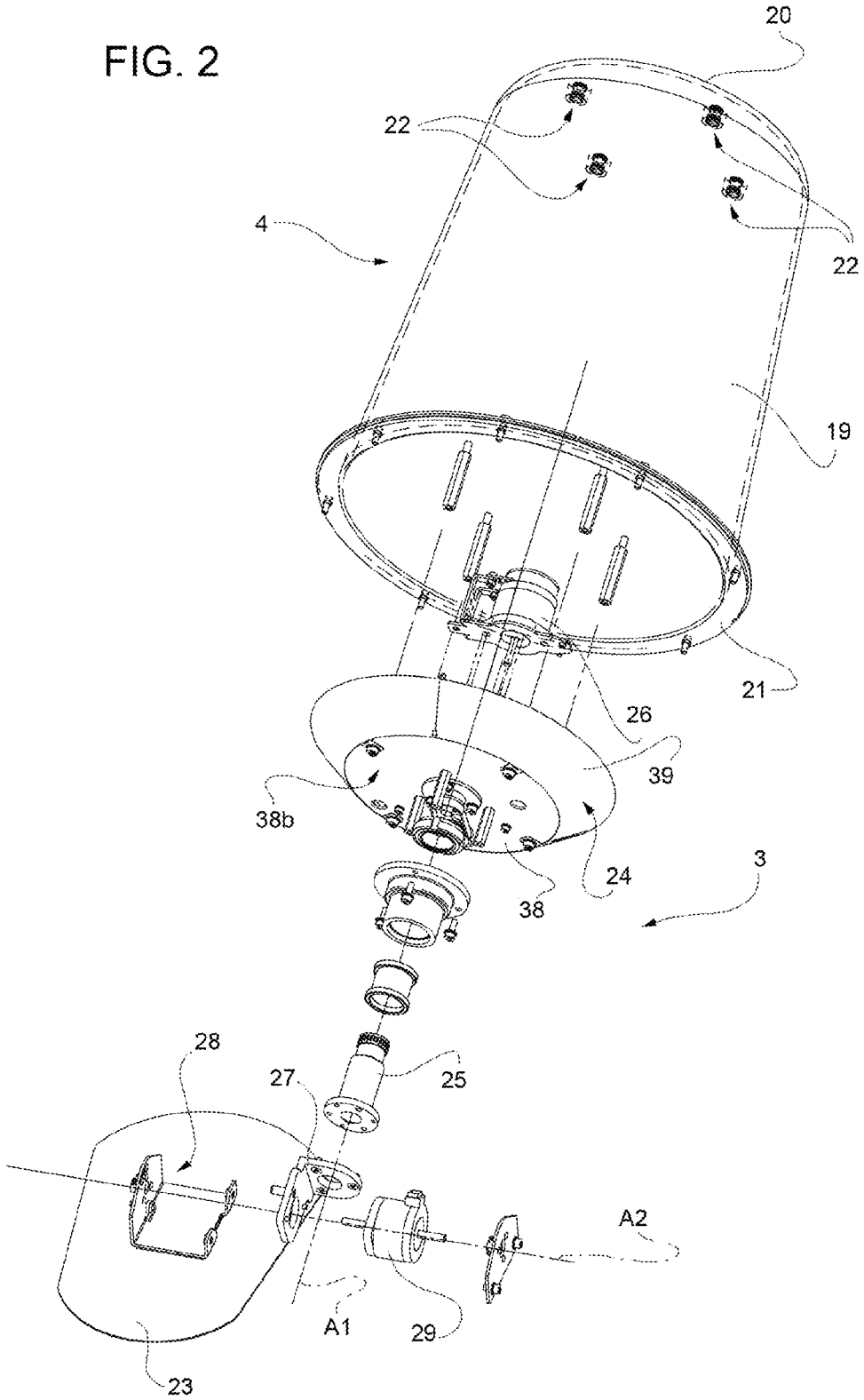
FIG. 2 is an exploded perspective view, with parts removed for the sake of clarity and on an enlarged scale, of a detail of the scenographic light fixture of FIG. 1.

With reference to FIG. 2, the support 4 is cup-shaped and comprises a lateral wall 19, a bottom wall 20, and a flange 21, which extends along the free edge of the lateral wall 19 and is configured to be hermetically fixed to the main body 2. The structure is provided with anchor clamps 22 for the control device 3, which is housed inside the waterproof chamber 5. In particular, in the example illustrated in the attached figures, the anchor clamps 22 are arranged along the bottom wall 20.

The control device 3 comprises an optical element 23 that can be selectively moved about two axes A1 and A2 that are transversal to one another, and is configured to intercept and direct the light beam in a plurality of directions through the support 4, which is made, at least in part, of a transparent material. In practice, the lateral wall 19 of the structure 4 is made of a transparent material. In the example illustrated in the attached figures the optical element is a reflector, known as a plane mirror. According to an embodiment that is not illustrated in the attached figures the optical element is defined by a prism capable of deflecting the light beam. The prism may also be structured to split the light beam into several diverging light beams.

The control device 3 comprises a frame 24, a shaft 25 of axis A1 parallel to the optical axis A, and an electric motor 26 to rotate the shaft 25 and the optical element 23 about the axis A1 with respect to the frame 24.

The control device 3 comprises a bracket 27 integrally fixed to the shaft 25, a fork 28 integrally fixed to the optical element 23, and an electric motor 29 mounted on the bracket 27 so as to pivot the optical element 23 about the axis A2.

The frame 24 comprises a plate 38 that is preferably flat and round, provided with an edge 39 sloping towards the bottom wall 20 and arranged so as to substantially come into contact with the bottom wall 20.

With reference to FIGS. 1 and 2, the frame 24 divides the chamber 5 substantially into an upper zone in which the electric motor 26 is housed and a lower zone 41 in which the optical element 23, the bracket 27, the fork 28 and the electric motor 29 are housed. The shaft 25 passes through the plate 38.

The plate 38 is provided with an upper surface 38*a* (FIG. 1) which faces the upper zone 40 and a lower surface 38*b* which faces the lower zone 41. A plurality of LEDs 42 are arranged along the upper surface 38*a*. Preferably, the LEDs 42 are arranged along one or more concentric circles in proximity to the perimeter portion of the plate 38. The LEDs may be white and/or red and/or green and/or blue and controlled separately or in groups.

Preferably, the bottom wall 20 is made of a material treated so as to filter direct light and turn it into diffused light and so as to prevent a clear and detailed view of the elements arranged inside the support 4, and in particular within the upper zone 40. In this way the light generated by the LEDs 42 is able to pass through the bottom wall 20 without making the individual LEDs 42 and the individual elements of the control device 3 housed in the upper zone 40 visible from the outside.

Preferably, the lateral wall 19 and the bottom wall 20 are made as a single piece.

More preferably, the lateral wall 19, the bottom wall 20 and the flange 21 are made as a single piece.

The support 4 is made of polymeric material, specifically Polymethylmethacrylate (PMMA) or Polycarbonate (PC).

According to a specific embodiment that is not illustrated in the attached figures, the support 4 is configured so as to have one optically active portion in order to modify the optical characteristics of the light beam that passes through the lateral wall 19 of the support 4.

In particular, the light fixture 1 comprises a plurality of interchangeable supports 4, each of which having different characteristics in terms of their size or optical properties.

The outer surface of the support 4 is coated with a water-repellent coating to attenuate the formation of droplets.

The electric cables (not illustrated in the attached figures) for supplying power to the electric motors 26 and 29 that drive the optical element 23 are also housed inside the chamber 5.

According to an alternative embodiment not illustrated in the attached figures the electric cables are sunk in the polymeric material of the support 4. Generally speaking, whether the electric cables are sunk or simply arranged inside the chamber 5, they do not alter the light beam when hit by the light beam.

In use, the main body 2 emits a relatively cohesive light beam along the main axis A. The optical element 23 deflects the light beam and directs the light beam along a direction determined as a function of the slope of the optical element 23 with respect to the axes A1 and A2.

The optical element 23 is capable of continuously rotating about the axis A1 and pivoting about the axis A2.

The main body 2 is capable of processing the light beam with colours, shapes and other effects according to scenographic requirements. The light fixture 1 is thus capable of processing the light beam in the desired way and of orientating the light beam in a plurality of directions without having to turn the actual light fixture.

In use, the activation of the LEDs 42 permits the diffused illumination of the bottom wall 20 regardless of whether or not the main body 2 emits the light beam.

Figure 5:
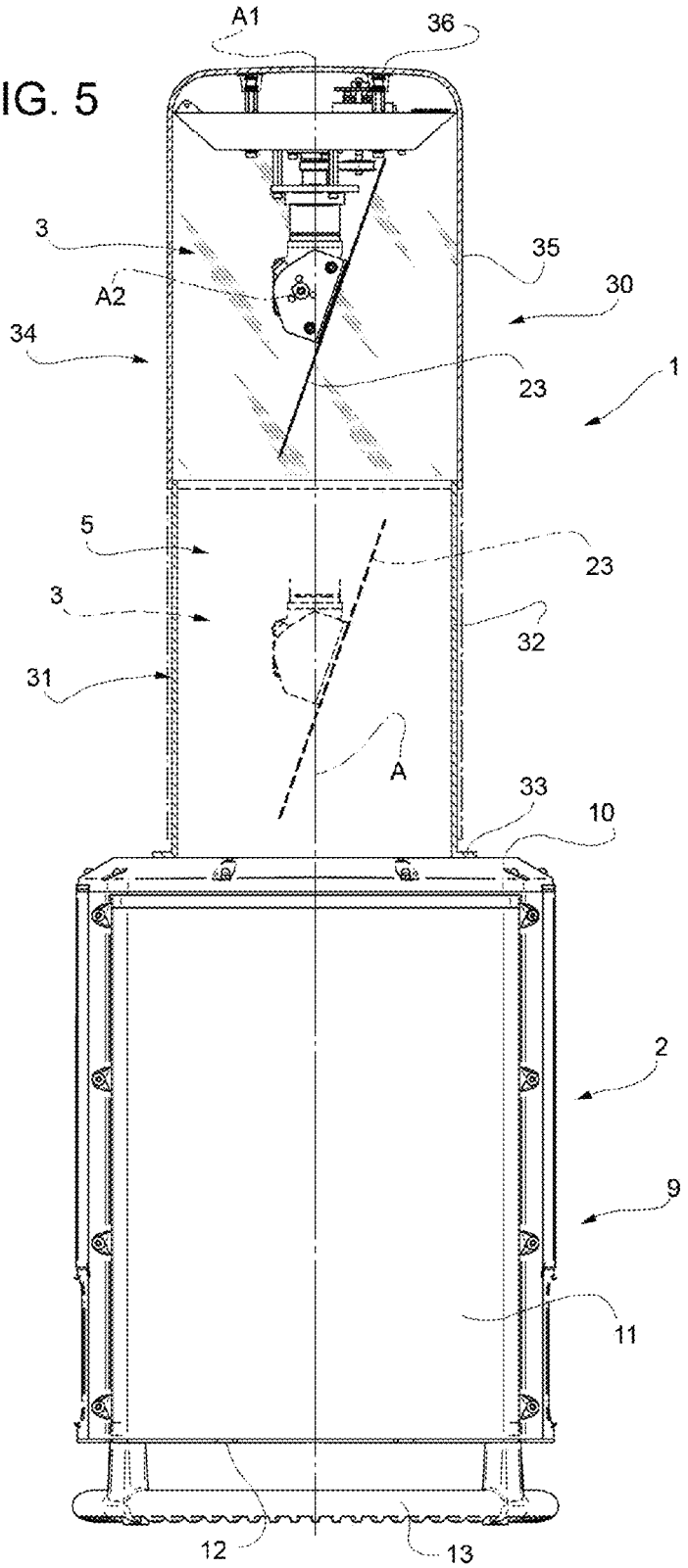
FIG. 5 is an elevation view, with parts removed for the sake of clarity, of a further embodiment of the scenographic light fixture according to the present invention.

In the alternative embodiment illustrated in FIG. 5, the light fixture 1 is equipped with a telescopic support 30, which comprises a cylindrical portion 31 provided with a cylindrical lateral wall 32 and a flange 33 hermetically fixed to the main body 2; and a cup-shaped portion 34 comprising a cylindrical lateral wall 35 slidingly coupled to the cylindrical wall 32 and a bottom wall 36 along which the control device 3 is fixed The distance between the main body and the control device 3 can therefore be adjusted depending on the specific circumstances. In FIG. 5, the control device 3 is shown by the unbroken line in the position furthest away from the main body 2 and by the broken line in the position nearest to the main body 2. Furthermore, if at least one of the cylindrical lateral walls 32 and 35 is provided with optically active zones, optical effects can be selectively created. Moreover, by adjusting the distance between the optical element 23 and the main body, it is possible to change the angle that can be covered by the light beam about the axis A2.

Preferably, the cylindrical lateral wall 35 and the bottom wall 36 are made as a single piece.

Preferably, the bottom wall 36 is made of a material treated so as to filter direct light and turn it into diffused light and in order to prevent a clear and detailed view of the elements arranged inside the support 30 through the bottom wall 36. In this way the light generated by the LEDs 42 is able to pass through the bottom wall 36 without making the individual LEDs 42 visible from the outside.

According to an alternative embodiment of the present invention, the upper wall 10 is fixed so as to rotate with respect to the lateral wall 11 and with the rest of the main body 2 and to rotate the support 30 about the optical axis (A).

Lastly, it is clear that modifications and variations may be made to the scenographic light fixture described herein without departing from the scope of the appended claims.

The invention claimed is:

1. A scenographic light fixture for producing a light beam, the light fixture comprising;

a main body configured to produce a light beam along an optical axis (A); a control device facing the main body and comprising a mobile optical element to intercept and selectively deflect the light beam in a plurality of directions;

and a support, which is at least in part transparent to the light beam, and is fitted to the main body to support the control device so as to define a waterproof chamber wherein the optical element moves and the main body is outside of the waterproof chamber;

wherein the support comprises an end flange, which is hermetically fitted to the main body;

wherein the main body comprises an air cooling system comprising at least one inlet and at least one outlet arranged along a lateral wall of the main body extending about the optical axis (A), said inlet and said outlet being arranged so that said lateral wall has a zone without openings which subtends an angle B of at least 130° about the optical axis (A).

2. The light fixture as claimed in claim 1, wherein the support is cup-shaped and the control device is housed in the chamber.

3. The light fixture as claimed in claim 1, wherein the support comprises at least one transparent lateral wall and one bottom wall along which the control device is fixed.

4. The light fixture as claimed in claim 1, wherein the support is made of polymeric material, preferably Polymethylmethacrylate (PMMA) or Polycarbonate (PC).

5. The light fixture as claimed in claim 1, wherein the support is configured so as to comprise at least one optically active portion in order to modify the optical characteristics of the light beam.

6. The light fixture as claimed in claim 1, and comprising a plurality of interchangeable supports.

7. The light fixture as claimed in claim 1, wherein the support has an outer surface which is coated with a water-repellent coating.

8. The light fixture as claimed in claim 1, wherein the support is UV opaque.

9. The light fixture as claimed in claim 1, wherein the main body comprises an upper wall selectively rotatable about the optical axis (A), said support being fitted to said upper rotatable wall.

10. The light fixture as claimed in claim 1, wherein the support is telescopic and can be lengthened and shortened along the optical axis (A) so as to change the position of the control device with respect to the main body.

11. The light fixture as claimed in claim 1, wherein the control device comprises a first motor configured to rotate the optical element about a first axis (A1) parallel to the optical axis (A) and a second motor configured to pivot the optical element about a second axis (A2) transversal to the first axis (A1).

12. The light fixture as claimed in claim 1, wherein the air cooling system comprises a plurality of inlets, and at least two outlets arranged at 90° with respect to the inlets about the optical axis (A).

13. The light fixture as claimed in claim 1, wherein the main body comprises a light source, an objective lens, and at least a light beam processing device (8) to selectively intercept the light beam and create scenographic effects.

14. The light fixture as claimed in claim 12, wherein the plurality of inlets are formed in a stacked configuration that extends along an axis parallel to the optical axis (A).

15. The light fixture as claimed in claim 1, wherein the lateral wall of the main body comprises a continuous wall that extends circumferentially about the optical axis (A).

* * * * *